US009784024B2

(12) United States Patent
Collado et al.

(10) Patent No.: US 9,784,024 B2
(45) Date of Patent: Oct. 10, 2017

(54) DOOR OPENER ASSEMBLY

(71) Applicant: ILLINOIS TOOL WORKS INC., Glenview, IL (US)

(72) Inventors: Daniel R. Collado, Chicago, IL (US); Mark Rimkus, Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 14/379,756

(22) PCT Filed: Feb. 14, 2013

(86) PCT No.: PCT/US2013/026077

§ 371 (c)(1),
(2) Date: Aug. 20, 2014

(87) PCT Pub. No.: WO2013/130275

PCT Pub. Date: Sep. 6, 2013

(65) Prior Publication Data

US 2015/0020460 A1 Jan. 22, 2015

Related U.S. Application Data

(60) Provisional application No. 61/603,538, filed on Feb. 27, 2012.

(51) Int. Cl.
*E05C 19/10* (2006.01)
*E05B 79/06* (2014.01)
(Continued)

(52) U.S. Cl.
CPC ..... *E05C 19/10* (2013.01); *E05B 79/06* (2013.01); *E05B 85/12* (2013.01); *E05C 1/12* (2013.01);
(Continued)

(58) Field of Classification Search
CPC ... E05C 19/10; E05C 1/12; E05F 11/54; B60J 5/04; E05B 1/00
See application file for complete search history.

(56) References Cited

U.S. PATENT DOCUMENTS 4,858,973 A * 8/1989 Ogasawara ..... E05B 85/12 292/347
5,101,597 A * 4/1992 Pelachyk ..... E05B 79/06 16/DIG. 24
(Continued)

FOREIGN PATENT DOCUMENTS

DE 2824216 A1 12/1979
JP S6263359 U 4/1987
(Continued)

OTHER PUBLICATIONS

Machine translation of JPH09317264.*
ISR and WO for PCT/US2013/026077 dated May 21, 2013.

*Primary Examiner* — Katherine Mitchell
*Assistant Examiner* — Scott Denion
(74) *Attorney, Agent, or Firm* — Joseph M. Butscher; The Small Patent Law Group, LLC

(57) ABSTRACT

A door opener assembly may include an opener housing including a well and at least one hook member. A pin-reception channel may be formed through a portion of the well. The hook member(s) is configured to hook onto a portion of a frame. The door opener assembly may also include a frame-securing member having a pin retained within the pin-reception channel. The frame-securing member is configured to be urged into the well to lock the opener housing to the portion of the frame.

20 Claims, 8 Drawing Sheets

(51) Int. Cl.

| | |
|---|---|
| ***E05B 85/12*** | (2014.01) |
| ***E05C 1/12*** | (2006.01) |
| ***E05F 11/54*** | (2006.01) |

(52) U.S. Cl.
CPC ..... *E05F 11/54* (2013.01); *Y10T 292/0948* (2015.04); *Y10T 292/57* (2015.04)

(56) References Cited

U.S. PATENT DOCUMENTS

| | | | | | |
|---|---|---|---|---|---|
| 5,129,694 | A * | 7/1992 | Tanimoto | E05B 1/0061 | 29/437 |
| 5,794,994 | A * | 8/1998 | Miyagawa | E05B 85/12 | 292/336.3 |
| 6,052,948 | A * | 4/2000 | Spitzley | E05B 79/06 | 49/460 |
| 2008/0129054 | A1 * | 6/2008 | Tremble | E05B 15/102 | 292/33 |
| 2009/0145041 | A1 * | 6/2009 | Yamada | B60J 5/04 | 49/501 |
| 2013/0088022 | A1 * | 4/2013 | Collado | E05B 85/12 | 292/336.3 |
| 2015/0020460 | A1 * | 1/2015 | Collado | E05B 79/06 | 49/504 |

FOREIGN PATENT DOCUMENTS

| | | | |
|---|---|---|---|
| JP | S62118856 | U | 7/1987 |
| JP | H09317264 | A | 12/1997 |
| JP | 2002089090 | A | 3/2002 |
| WO | 9800267 | A1 | 1/1998 |

* cited by examiner

DOOR OPENER ASSEMBLY

RELATED APPLICATIONS

This application is National Phase of International Application Number PCT/US2013/026077 filed Feb. 14, 2013 and claims priority benefits from U.S. Provisional Patent Application No. 61/603,538 entitled "Vehicle Door Opener Assembly," filed Feb. 27, 2012, which is hereby incorporated by reference in its entirety.

FIELD OF EMBODIMENTS OF THE DISCLOSURE

Embodiments of the present disclosure generally relate to a door opener assembly configured for use with a vehicle, such as an automobile.

BACKGROUND

A typical vehicle, such as an automobile, includes doors that allow individuals, such as a driver and passenger(s), to enter the interior cabin of the vehicle. Once the doors are closed, the individuals may exit the vehicle by grasping and manipulating interior door openers, having a pivotal handle, for example.

Typically, an interior door opener is secured to a frame of the vehicle. In particular, known interior door openers are secured to vehicle frames through fasteners, such as screws, bolts, and nuts. However, the process of manufacturing and securing the door opener through the separate and distinct fasteners is time-consuming and labor-intensive. Moreover, the use of separate and distinct fasteners increases the number of parts. The separate and distinct parts may be easily lost or misplaced during the assembly process. Further, the use of separate and distinct fasteners typically adds weight to the door opener.

SUMMARY OF EMBODIMENTS OF THE DISCLOSURE

Certain embodiments of the present disclosure provide a door opener assembly that may include an opener housing including a well and at least one hook member. A pin-reception channel is formed through a portion of the well. The hook member(s) is configured to hook onto a portion of a frame. The door opener assembly may also include a frame-securing member having a pin retained within the pin-reception channel. The frame-securing member is configured to be urged into the well to lock the opener housing to the portion of the frame. The opener housing may lock to the portion of the frame without separate and distinct fasteners.

The opener housing may also include pin-securing clips proximate to the pin-reception channel. The pin may include one or more notches configured to retain portions of the pin-securing clips to secure the frame-securing member to the opener housing.

The frame-securing member may include a cap connected to the pin. The cap is configured to be retained within a cap recess formed in the well.

The pin may also include at least one securing snap configured to snapably secure to one or both of the portion of the frame or the opener housing. A tip of the pin prevents the opener housing from shifting with respect to the frame when the securing snap is snapably secured to one or both of the portion of the frame or the opener housing.

Certain embodiments of the present disclosure provide a vehicle door that includes a frame, and a door opener assembly securely locked to the frame. The door opener assembly may include an opener housing including a well and at least one hook member. A pin-reception channel is formed through a portion of the well. The hook member(s) hooks onto a portion of the frame. The door opener assembly may also include a frame-securing member having a pin retained within the pin-reception channel. The frame-securing member securely locks the opener housing to the portion of the frame.

The frame may include at least one hook channel. The hook member(s) hooks onto the frame through the hook channel(s). The tip of the pin and at least a portion of the hook member(s) may be positioned within the hook channel (s). The tip of the pin prevents the hook member(s) from shifting with respect to the hook channel(s).

Figure 1:
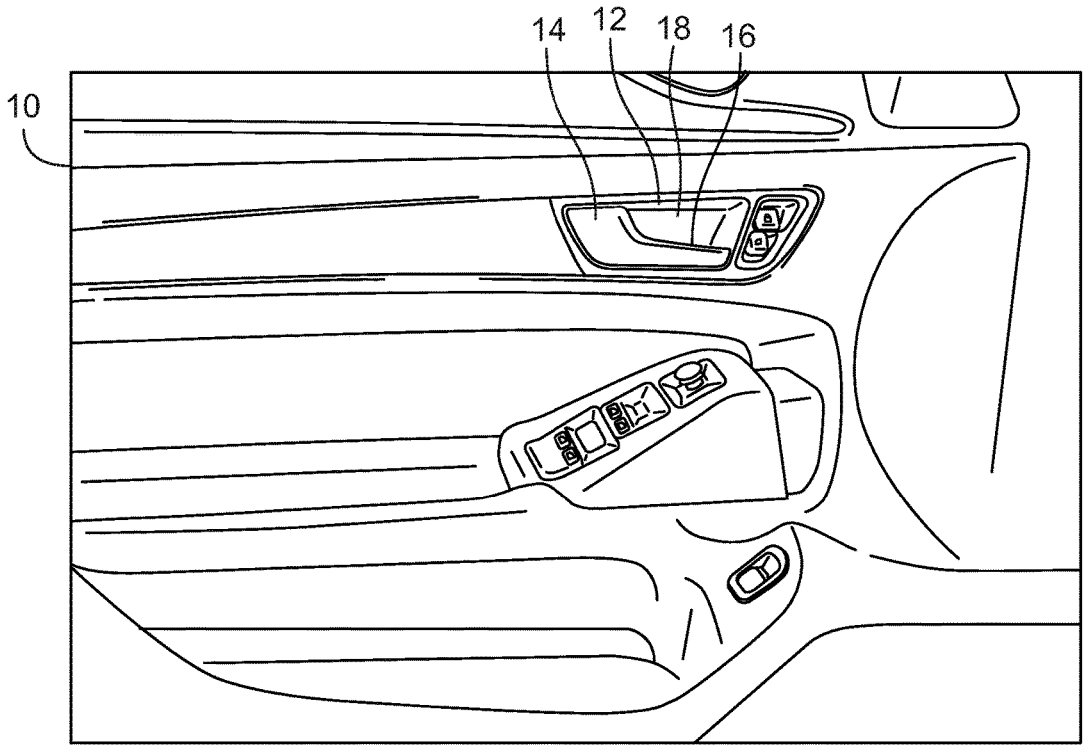
FIG. 1 illustrates an interior view of a vehicle door, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates an interior view of a vehicle door 10, according to an embodiment of the present disclosure. The vehicle door 10 includes a door opener assembly 12 secured to a vehicle frame (hidden from view). The door opener assembly 12 includes a pivotal handle 14 having a graspable beam 16 positioned over a portion of a finger well 18. In order to open the vehicle door 10, a user grasps the beam 16 and pivots the handle 14 toward the user. The handle 14 is operatively connected to a latching member within the door that disengages from a latched component when the handle 14 is pivoted as noted.

The vehicle door 10 and door opener assembly 12 may be shaped and sized different than shown. For example, the door opener assembly 12 may be shaped and sized to securely attach to any vehicle frame.

Figure 2:
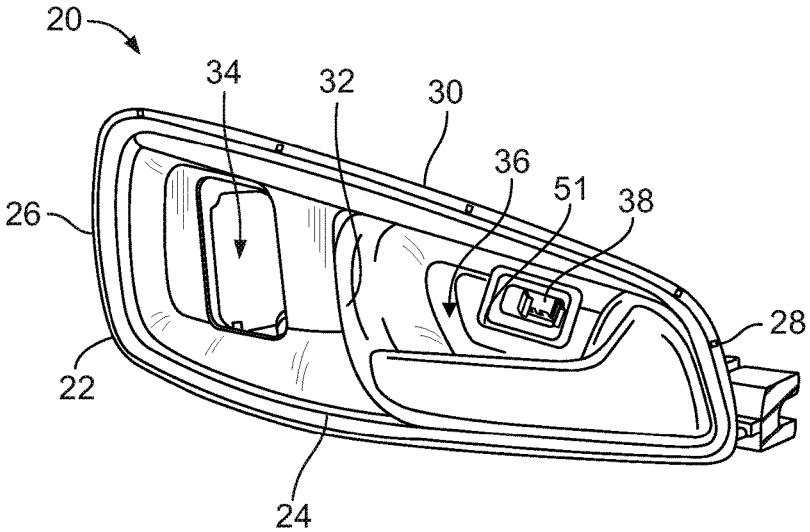
FIG. 2 illustrates an isometric front view of an opener housing, according to an embodiment of the present disclosure.

FIG. 2 illustrates an isometric front view of an opener housing 20, according to an embodiment of the present disclosure. The opener housing 20 may be formed of one or both of plastic or metal. The opener housing 20 includes a main body 22 having a base 24 integrally connected to lateral rims 26, which are in turn integrally connected to a top rim 30. The base 24, lateral rims 26, and top rim 30 define an internal chamber 32 having an interior surface. A handle cavity 34 is proximate to a lateral rim 26, while a well 36, which may be configured as a finger well, is proximate to an opposite lateral rim 26. The handle cavity 34 is configured to receive and pivotally retain a base of a handle (shown in FIG. 1) that is operatively connected to a latching mechanism that allows a door to be selectively opened and securely closed. A beam of the handle is configured to span over at least a portion of the well 36. A user may grasp the beam of the handle within the well 36 and pivot the handle to open the door.

The well 36 also includes a pin-reception channel 38 formed therethrough. The pin-reception channel 38 is configured to receive a pin of a securing member to secure the opener housing 20 to a frame, as discussed below.

The opener housing 20 may be sized and shaped differently than shown in FIG. 2. The opener housing 20 may be sized and shaped to secure to a variety of frames, such as different frames of vehicles. The opener housing 20 may be rectangular, circular, elliptical, or the like, depending on the size and shape of a door, frame, and the like.

Figure 3:
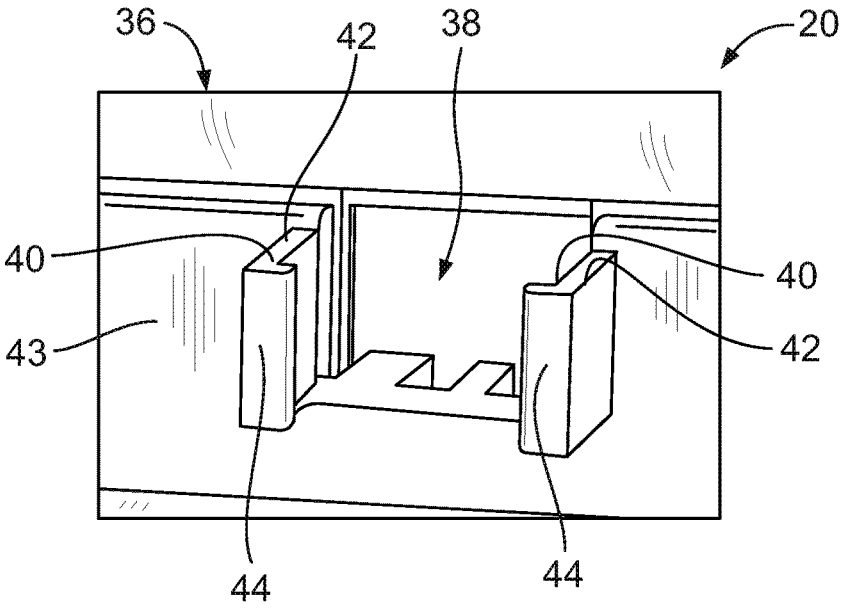
FIG. 3 illustrates an isometric front view of a pin-reception channel of an opener housing, according to an embodiment of the present disclosure.

FIG. 3 illustrates an isometric front view of the pin-reception channel 38 of the opener housing 20. The pin-reception channel 38 is flanked by opposed pin-retaining clips 40. Each pin-retaining clip 40 includes an extension beam 42 extending from a wall 43 of the well 36. The extension beam 42 is integrally connected to a distal tab 44. The distal tab 44 may generally be perpendicular to the extension beam 42 and oriented toward the pin-reception channel 38. Each distal tab 44 is configured to be received and retained within a reciprocal notch of a pin of a securing member, as explained below. Alternatively, the pin of the securing member may include retaining clips, while the pin-reception channel includes reciprocal notches, grooves, or the like configured to retain portions of the retaining clips.

Figure 4:
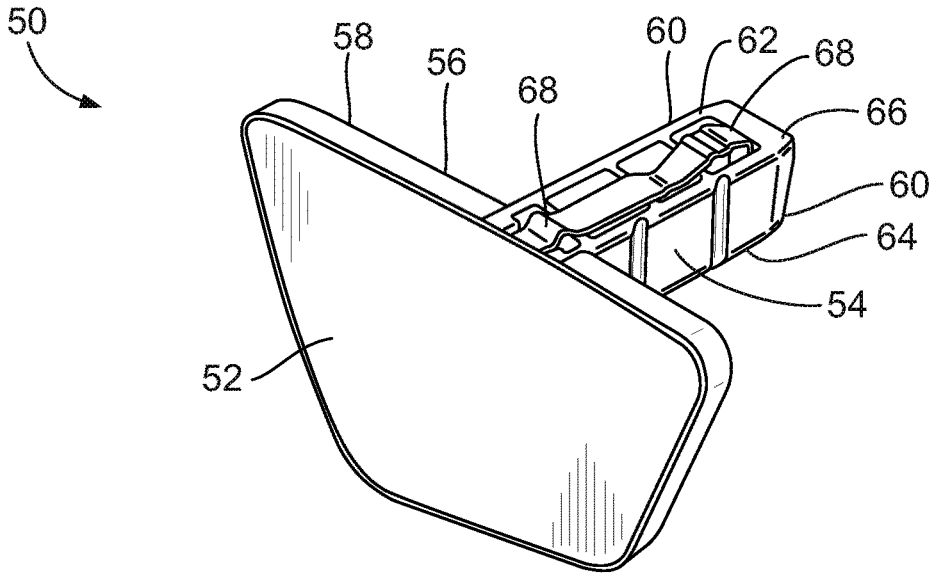
FIG. 4 illustrates an isometric top view of a frame-securing member, according to an embodiment of the present disclosure.

FIG. 4 illustrates an isometric top view of a frame-securing member 50, according to an embodiment of the present disclosure. The frame-securing member 50 may be formed of one or both of plastic or metal. The frame-securing member 50 includes a cap 52 having a pin 54 extending perpendicularly from a rear surface 56. The pin 54 may extend proximate an upper edge 58 of the cap 52. However, the pin 54 may extend proximate various other areas of the cap 52, such as a middle section.

The cap 52 is configured to be received in the well 36 (shown in FIGS. 1 and 2) within a reciprocal cap recess 51 (shown in FIG. 1). The pin 54 is configured to be received and retained within the pin-reception channel 38 (shown in FIGS. 1 and 2).

The pin 54 includes opposed lateral walls 60 integrally connected to top and bottom walls 62 and 64, respectively. Notches 66 are formed through portions of each lateral wall 60. Alternatively, as noted above, the pin 54 may include securing clips, while notches, grooves, or the like, are formed within the pin-reception channel 38 (shown in FIG. 3). Securing snaps 68 extend from the top wall 62.

Figure 5:
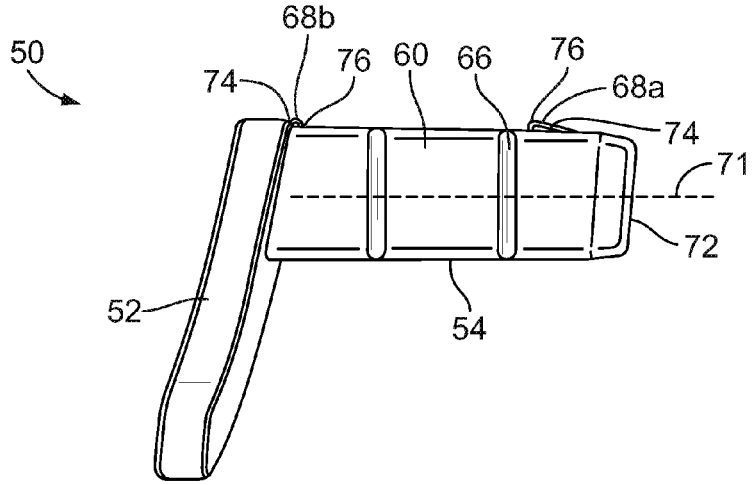
FIG. 5 illustrates a lateral view of a frame-securing member, according to an embodiment of the present disclosure.

FIG. 5 illustrates a lateral view of the frame-securing member 50. The cap 52 may be a generally planar member having a curved bottom edge 70. The cap 52 is sized and shaped to fit within the cap recess 51. As noted, the cap 52 may be sized and shaped in various configurations to fit within a particular cap recess.

The notches 66 may be linear and extend from the bottom wall 64 to the top wall 62. Each notch 66 may be perpendicular to a longitudinal axis 71 of the pin 54. The notches 66 are configured to receive and retain the distal tabs 44 of the pin-retaining clips 40 (shown in FIG. 3). As a distal tab 44 is urged into a notch 66, the distal tab 44 may be further urged toward the cap 52, but may be prevented from retreating toward a tip 72 by way of the interaction between the distal tab 44 and the notch 66.

The securing snap 68*a* may include a ramped surface 74 proximate the tip 72. The ramped surface 74 integrally connects to a straight edge 76 closer to the cap 52. Similarly, the securing snap 68*b* may include a ramped surface 74 proximate the cap 52 and a straight edge 76 closer to the tip 72. Alternatively, the pin 54 may include only the securing snap 68*a*.

Figure 6:
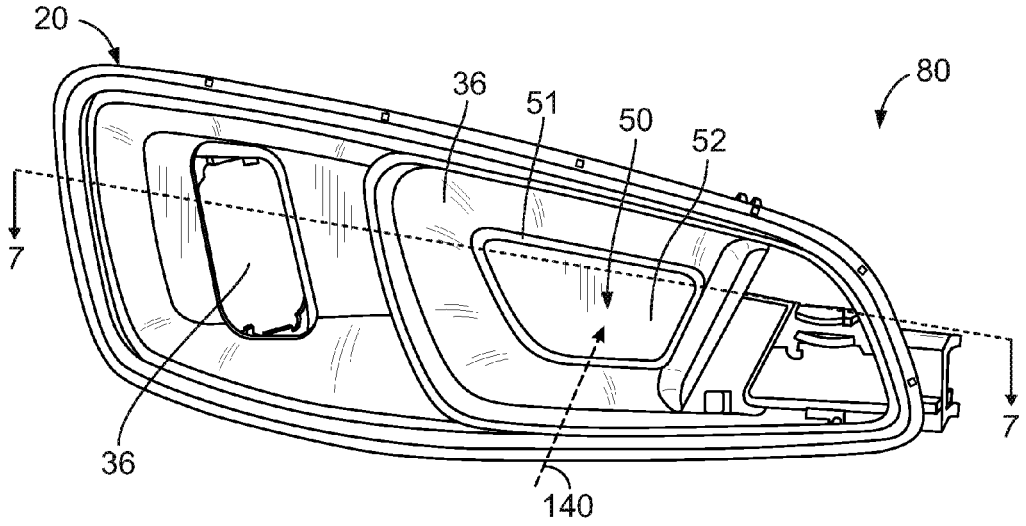
FIG. 6 illustrates a front view of a door opener assembly, according to an embodiment of the present disclosure.

FIG. 6 illustrates a front view of a door opener assembly 80, according to an embodiment of the present disclosure. The door opener assembly 80 includes the opener housing 20 and the frame-securing member 50 within the well 36. In particular, the cap 52 is retained within the cap recess 51.

Figure 7:
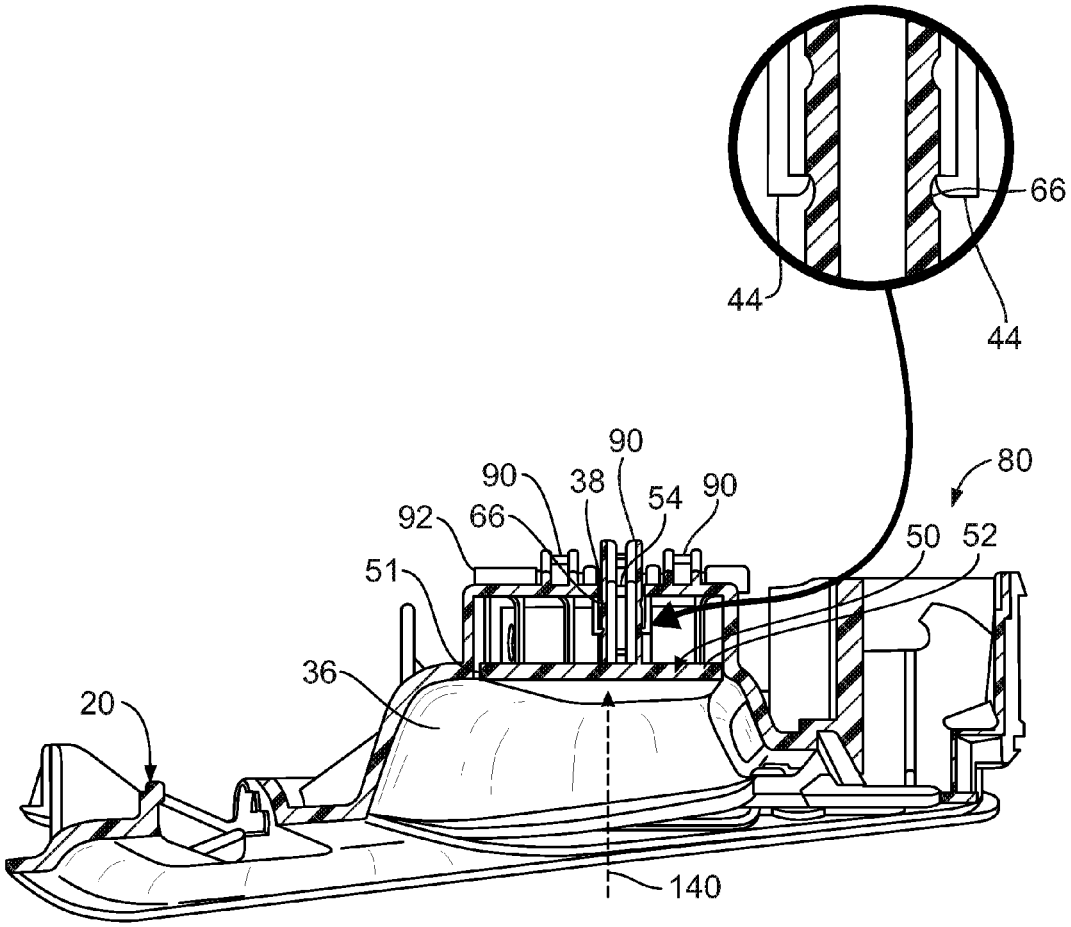
FIG. 7 illustrates a cross-sectional view of a door opener assembly through line 7-7 of FIG. 6, according to an embodiment of the present disclosure.

FIG. 7 illustrates a cross-sectional view of the door opener assembly 80 through line 7-7 of FIG. 6, according to an embodiment of the present disclosure. As shown in FIG. 7, the pin 54 of the frame-securing member 50 is urged into the pin-reception channel 38. The opposed distal tabs 44 of the pin-retaining clips 40 are retained within the opposed notches 66, thereby securing the securing member 50 to the opener housing 20.

Hook members 90 extend from a rear wall 92 of the opener housing 20. The hook members 90 are configured to hook onto a portion of a frame, as described below.

Figure 8:
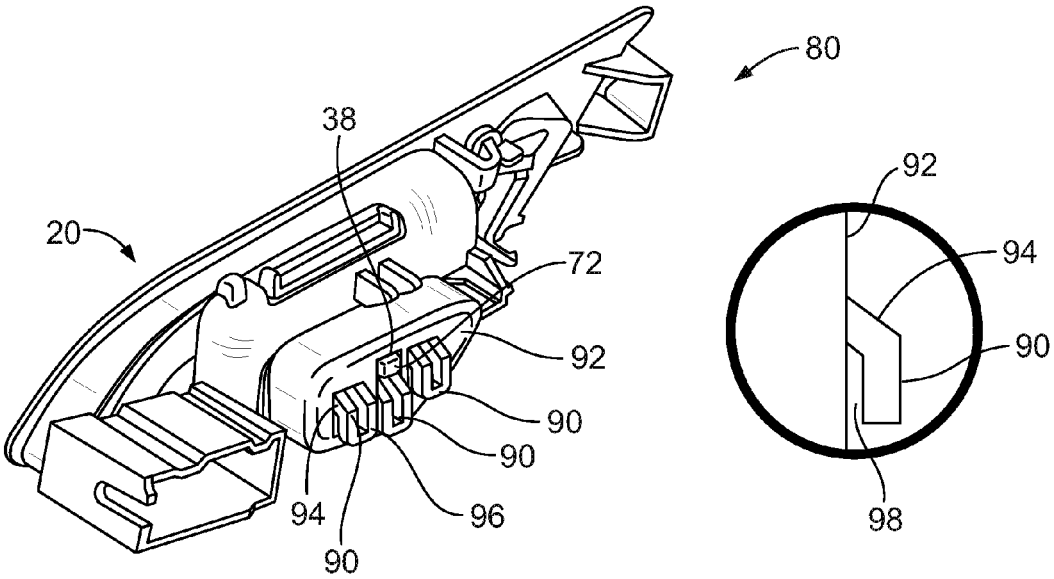
FIG. 8 illustrates an isometric rear view of a door opener assembly, according to an embodiment of the present disclosure.

FIG. 8 illustrates an isometric rear view of the door opener assembly 80, according to an embodiment of the present disclosure. As shown, three hook members 90 extend from the rear wall 92. Alternatively, more or less hook members 90 may be used. However, the use of three hook members 90, with the middle hook member 90 being offset below or above the lateral hook members 90, provides a strong, secure, stable connection with a frame. Each hook member 90 includes an extension beam 94 that extends outwardly from the rear wall 92. A hooking beam 96 extends from a distal end of the extension beam 94. A clearance gap is defined between the hooking beam 96 and the rear wall 92. The clearance gap is configured to receive an internal edge of a frame portion, for example.

The pin-reception channel 38 is positioned above the middle hook member 96. The tip 72 of the pin 54 is positioned above the middle hook member 96. Alternatively, the frame-securing member 50 may include multiple pins, such as three pins. Each tip of a pin may be positioned over a respective hook member 90. Moreover, instead of a middle pin, the frame-securing member 50 may include two spaced pins that are on opposite sides of the middle hook member 96.

As shown in FIGS. 6-8, the door opener assembly 80, including the opener housing 20 and the securing member 50, may be pre-assembled as a single unit. Accordingly, the door opener assembly 80 may be shipped as a single unit.

Figure 9:
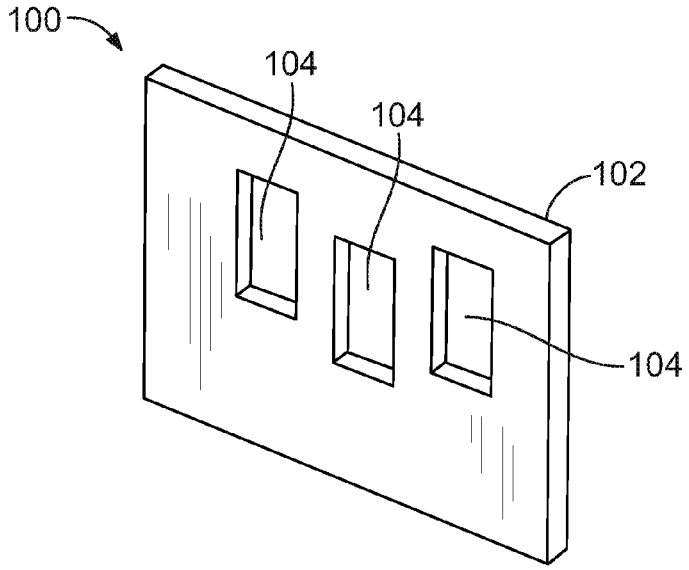
FIG. 9 illustrates an isometric front view of a frame portion, according to an embodiment of the present disclosure.

FIG. 9 illustrates an isometric front view of a frame portion 100, according to an embodiment of the present disclosure. The frame portion 100 is a portion of a frame of a vehicle. For the sake of clarity, only a small portion of the frame is shown. However, it is to be understood that the frame portion 100 may be various sizes and shapes.

The frame portion 100 includes a main body 102, which may be formed of sheet metal, for example. Hook channels 104 are formed through the main body 102. The hook channels 104 are sized and shaped to cooperate with the hook members 90 that extend from the rear wall 92 of the opener housing 20 (shown in FIGS. 7 and 8). More or less hook channels 104 may be used, depending on the number of hook members 90.

Figure 10:
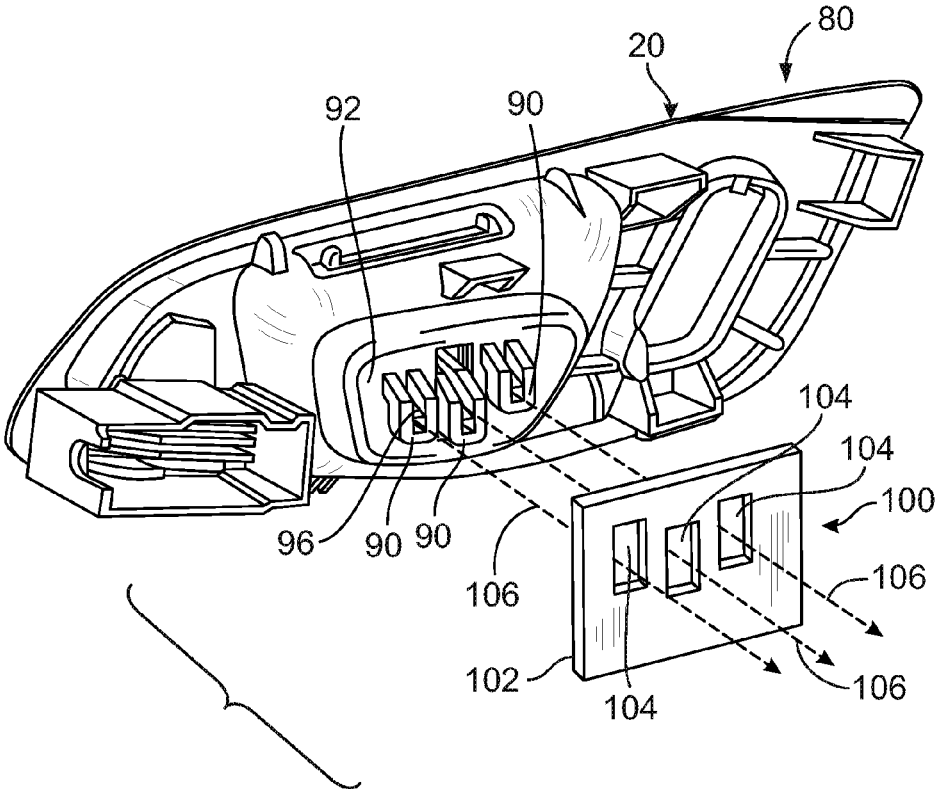
FIG. 10 illustrates an isometric rear view of a door opener assembly aligned with a frame portion, according to an embodiment of the present disclosure.

FIG. 10 illustrates an isometric rear view of the door opener assembly 80 aligned with the frame portion 100, according to an embodiment of the present disclosure. In order to secure the door opener assembly 80 to the frame portion 100, the three hook members 90 are aligned with the three reciprocal hook channels 104. Once aligned, the door opener assembly 80 is urged toward the frame portion 100 in the direction of arrows 106 so that the hook members 90 pass into the hook channels 104. The hooking beams 96 pass through the hook channels 104 until the rear wall 92 of the opener housing 20 abuts against the front surface of the main body 102 of the frame portion 100, thereby blocking further movement of the door opener assembly 80.

Figure 11:
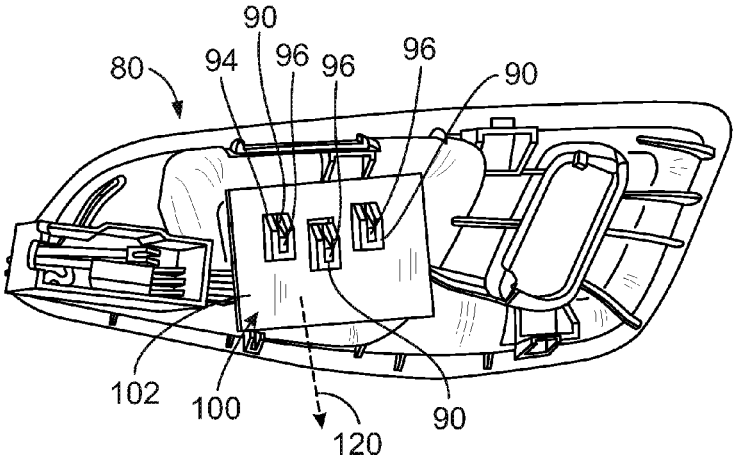
FIG. 11 illustrates an isometric rear view of a door opener assembly in an initial mating state with a frame portion, according to an embodiment of the present disclosure.

FIG. 11 illustrates an isometric rear view of the door opener assembly 80 in an initial mating state with the frame portion 100, according to an embodiment of the present disclosure. As shown, the hooking beams 96 extend through the hook channels 104 (which are shown clearly in FIG. 10). Next, in order to secure the hook member 90 to the frame portion 100, the door opener assembly 80 is urged downwardly in the direction of arrow 120. As such, the hooking beams 96 hook over portion of the main body 102 of the frame portion 100. The door opener assembly 80 is urged in the direction of arrow 120 until lower edges of the main body 102 that define the hook channels 104 abut against interior surfaces of the extension beams 94 of the hook members 90.

Figure 12:
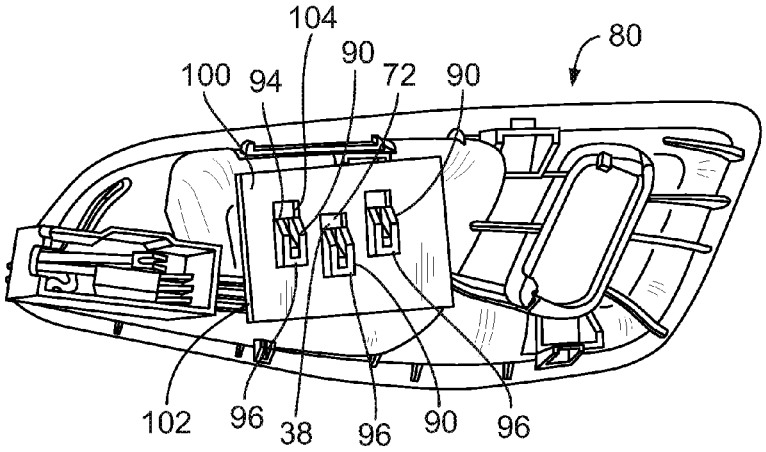
FIG. 12 illustrates an isometric rear view of a door opener assembly in an intermediate secured state with a frame portion, according to an embodiment of the present disclosure.

FIG. 12 illustrates an isometric rear view of the door opener assembly 80 in an intermediate secured state with the frame portion 100, according to an embodiment of the present disclosure. As shown, the hook members 90 securely hook onto the frame portion 100 by way of the hooking beams 96 hooking over portions of the main body 102 that define the hook channels 104. Accordingly, the door opener assembly 80 is prevented from ejecting from the frame portion 100 in a direction opposite to the direction of arrows 106 in FIG. 10.

Additionally, as shown, once the door opener assembly 80 is moved down so that the hooking beams 96 securely hook onto the frame portion 100, the tip 72 of the pin 54 of the frame-securing member 50 (shown in FIGS. 4 and 5) is exposed through the pin-reception channel 38. In order to fully secure the door opener assembly 80 to the frame portion 100, the frame-securing member 50 is urged toward the frame portion 100 so that the tip 72 passes into the middle hook channel 104.

Figure 13:
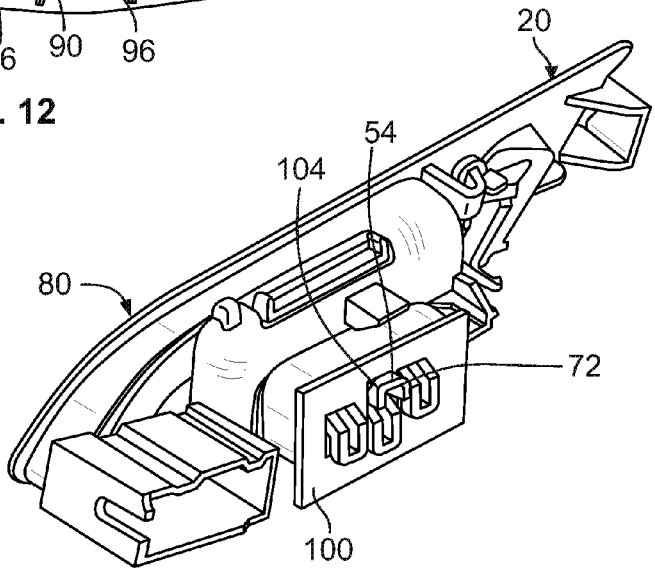
FIG. 13 illustrates an isometric rear view of a door opener assembly in a fully-secured state with a frame portion, according to an embodiment of the present disclosure.

FIG. 13 illustrates an isometric rear view of the door opener assembly 80 in a fully-secured or locked state with the frame portion 100, according to an embodiment of the present disclosure. Referring to FIGS. 6, 7, and 13, in order to fully secure the door opener assembly 80 to the frame portion 100, the cap 52 is pressed inwardly in the direction of arrow 140 so that the tip 72 of the pin 54 is forced through the middle hook channel 104, and snapably secures to the frame portion 100 and/or the rear wall of the opener housing 20.

Figure 14:
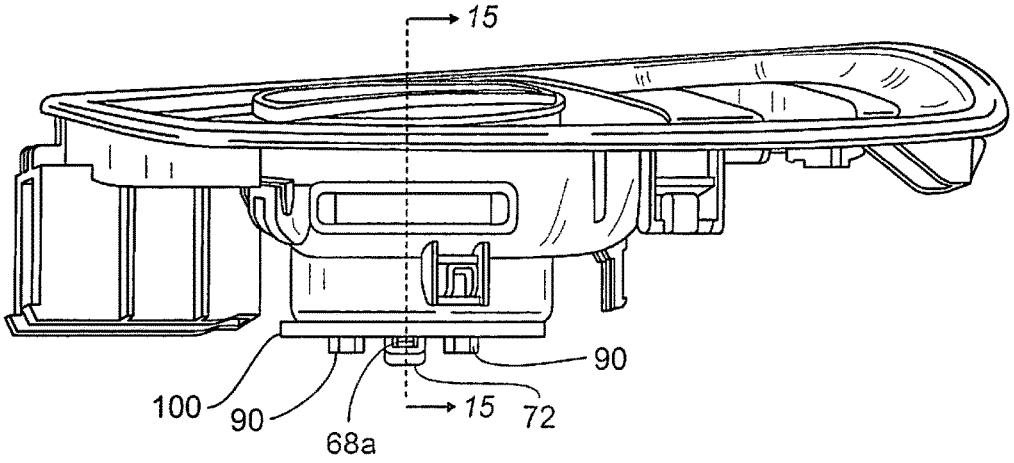
FIG. 14 illustrates a top view of a door opener assembly in a fully-secured state with a frame portion, according to an embodiment of the present disclosure.

FIG. 14 illustrates a top view of the door opener assembly 80 in a fully-secured or locked state with the frame portion 100, according to an embodiment of the present disclosure. Once the tip 72 is urged into the middle hook channel 104, the securing snap 68 snapably engages the frame portion 100 over the middle hook channel 104.

Figure 15:
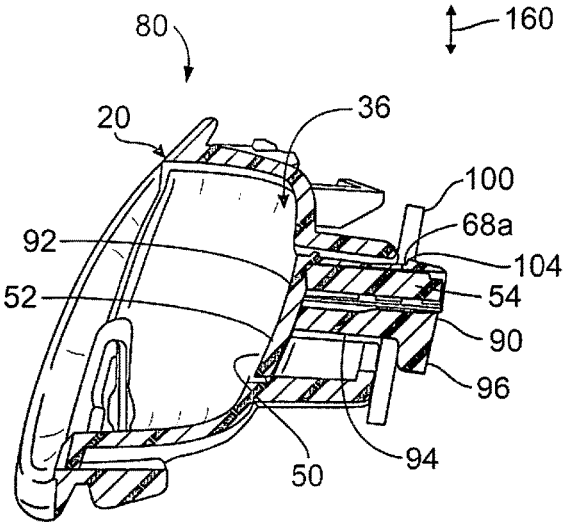
FIG. 15 illustrates a cross-sectional view of a door opener assembly in a fully-secured state through line-15-15 of FIG. 14, according to an embodiment of the present disclosure.

FIG. 15 illustrates a cross-sectional view of the door opener assembly 80 in a fully-secured state through line-15-15 of FIG. 14, according to an embodiment of the present disclosure. As shown, the securing snap 68*a* is securely retained within the middle hook channel 104 over the middle hook member 90. The securing snap 68*a* may snapably secure to a portion of one or both of the frame portion 100 and/or the rear wall 92 of the opener housing 20. Moreover, the middle hook member 90 abuts into the pin 54, and is therefore prevented from shifting within the hook channel 104 in the directions of arrow 160. Accordingly, the door opener assembly 80 is fully secured and locked to the frame portion 100.

Figure 16:
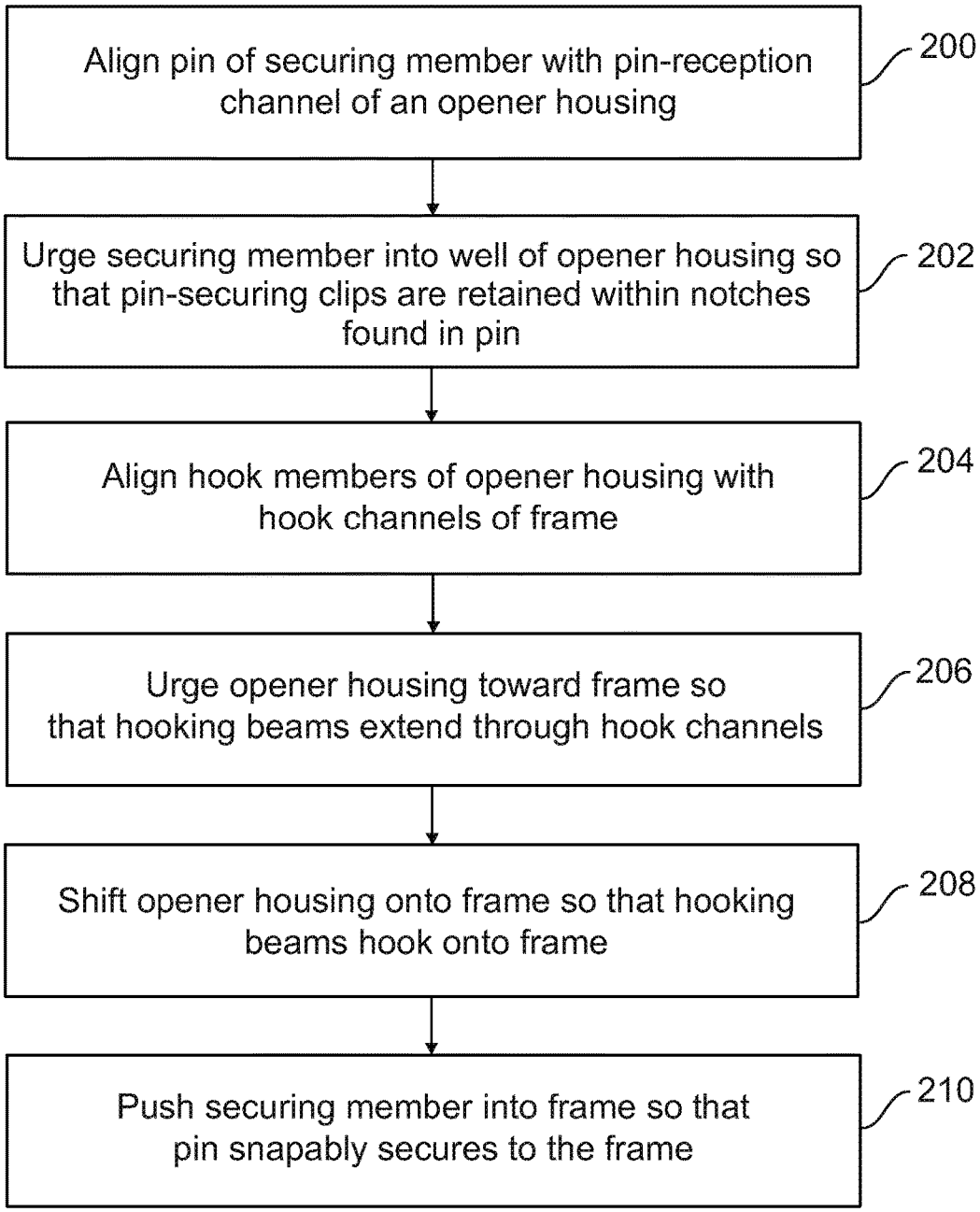
FIG. 16 illustrates a flow chart of a method of securing a door opener assembly to a frame, according to an embodiment of the present disclosure.

FIG. 16 illustrates a flow chart of a method of securing a door opener assembly to a frame, according to an embodiment of the present disclosure. At 200, a pin of a securing member is aligned with a pin-reception channel of an opener housing. Next, at 202, the securing member is urged into a well of the opener housing so that pin-retaining clips are retained within notches formed in the pin. Accordingly, the securing member is secured to the opener housing.

At 204, hook members of the opener housing are aligned with hook channels formed through a frame. The opener housing is then urged toward the frame at 206, so that hooking beams of the hook members extend through the hook channels. Then, at 208, the opener housing is shifted with respect to the frame so that the hooking beams hook onto the frame.

After the opener housing is hooked onto the frame, the securing member is pushed into the frame at 210 so that the pin snapably secures to the frame. Because the pin is positioned over a hooking member within the hook channel, the pin blocks the hooking member from shifting within the hook channel. As such, the door opener assembly is prevented from shifting with respect to the frame, and the door opener assembly is fully secured and locked to the frame.

As explained above, embodiments of the present disclosure provide a door opener assembly that includes an opener housing that is attached to a frame, such as a door frame of a vehicle, by one or more hooked protrusions or members. A frame-securing member is then snapped into place with respect to the frame, thereby ensuring that the hook members remain secured within hook channels. As such, the door opener assembly provides a strong mechanical bond with the frame without the need to use separate and distinct tools (such as a screwdriver, for example). Moreover, unlike a screw and nut combination, the assembly is less, or otherwise not, susceptible to fasteners becoming loose over time.

Embodiments of the present disclosure provide a door opener assembly that is secured to a vehicle frame through a securing member, for example. Embodiments eliminate the need for separate and distinct screws and nuts, for example, which require additional tools during assembly. As such, embodiments provide a door opener assembly that is manufactured and secured to a frame using less components. Embodiments provide a door assembly that is also lighter than known door openers. Additionally, embodiments provide a door opener assembly that is assembled quicker and easier than known door openers.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. A door opener assembly comprising:

an opener housing configured for use with a vehicle door, the opener housing including a well and at least one hook member, wherein a pin-reception channel is formed through a portion of the well, and wherein the at least one hook member is configured to hook onto a portion of a frame via an opening in the frame, the opener housing comprising pin-retaining clips adjacent the opening, each pin-retaining clip comprising a distal tab; and a frame-securing member having a pin integrally formed with the frame-securing member as a single piece, the pin comprising corresponding notches which engage the distal tabs of each pin-retaining clip, wherein the pin is retained within the pin-reception channel, wherein the frame-securing member is configured to be urged into the well to lock the opener housing to the portion of the frame when the pin of the frame-securing member directly engages with the opener housing and the frame, the pin extending through the opening in the frame.

2. The door opener assembly of claim 1, wherein the opener housing locks to the portion of the frame via the frame-securing member without separate and distinct fasteners.

3. The door opener assembly of claim 1, wherein the notches are configured to retain portions of the pin-retaining clips to secure the frame-securing member to the opener housing.

4. The door opener assembly of claim 1, wherein the frame-securing member further comprises a cap connected to the pin, wherein the cap is configured to be retained within a cap recess formed in the well.

5. The door opener assembly of claim 1, wherein the pin comprises at least one securing member configured to lockably secure to one or both of the portion of the frame or the opener housing.

6. The door opener assembly of claim 5, wherein a tip of the pin prevents the opener housing from shifting with respect to the frame when the at least one securing member is lockably secured to one or both of the portion of the frame or the opener housing.

7. A vehicle door comprising:

a frame; and a door opener assembly securely locked to the frame via an opening in the frame, wherein the door opener assembly comprises:

an opener housing comprises a well and at least one hook member, wherein a pin-reception channel is formed through a portion of the well, and wherein the at least one hook member hooks onto a portion of the frame, and the opener housing further comprises pin-retaining clips adjacent the opening, each pin-retaining clip comprising a distal tab, and a frame-securing member having a pin integrally formed with the frame-securing member as a single piece, the pin comprising corresponding notches which engage the distal tabs of each pin-retaining clip, wherein the pin is retained within the pin-reception channel, wherein the frame-securing member securely locks the opener housing to the portion of the frame when the pin of the frame-securing member directly engages with the opener housing and the frame, the pin extending through the opening in the frame.

8. The vehicle door of claim 7, wherein the opener housing locks to the portion of the frame via the frame-securing member without separate and distinct fasteners.

9. The vehicle door of claim 7, wherein the notches are configured to retain portions of the pin retaining cups to secure the frame-securing member to the opener housing.

10. The vehicle door of claim 7, wherein the frame-securing member further comprises a cap connected to the pin, wherein the cap is retained within a cap recess formed in the well.

11. The vehicle door of claim 7, wherein the pin comprises at least one securing member secured to one or both of the portion of the frame or the opener housing.

12. The vehicle door of claim 7, wherein a tip of the pin prevents the opener housing from shifting with respect to the frame.

13. The vehicle door of claim 7, wherein the frame comprises at least one hook channel, wherein the at least one hook member hooks onto the frame through the at least one hook channel.

14. The vehicle door of claim 13, wherein the tip of the pin and at least a portion of the at least one hook member are positioned within the at least one hook channel, and wherein the tip of the pin prevents the at least one hook member from shifting with respect to the at least one hook channel.

15. The vehicle door of claim 7, wherein the at least one hook member comprises three hook members, and the at least one hook channel comprises three hook channels.

16. A door opener assembly comprising: an opener housing configured for use with a vehicle door, the opener housing including a well, at least one hook member, and pin-retaining clips proximate to a pin-reception channel formed through a portion of the well, and wherein the at least one hook member is configured to hook onto a portion of a frame via an opening in the frame; the opener housing comprising pin-retaining clips adjacent the opening, each pin-retaining clip comprising a distal tab; and said door opener assembly further composes an integrally-formed frame-securing member including a cap integrally with a pin that is retained within the pin-reception channel, wherein the pin comprises one or more notches configured to retain portions of the pin-securing clips to secure the frame-securing member to the opener housing, and wherein the frame-securing member is configured to be urged into the well to lock the opener housing to the portion of the frame without separate and distinct fasteners when the pin of the frame-securing member directly engages with the opener housing and the frame, the pin extending through the opening in the frame.

17. The door opener assembly of claim 16, wherein the cap is configured to be retained within a cap recess formed in the well.

18. The door opener assembly of claim 16, wherein the pin comprises at least one securing member configured to lockably secure to one or both of the portion of the frame or the opener housing.

19. The door opener assembly of claim 18, wherein a Up of the pin prevents the opener housing from shifting with respect to the frame when the at least one securing member is lockably secured to one or both of the portion of the frame or the opener housing.

20. The door opener assembly of claim 16, wherein the pin extends perpendicularly from a rear surface of the cap.

* * * * *